United States Patent [19]

Panagiotoulis

[11] 4,059,891

[45] Nov. 29, 1977

[54] BLADE AND IMPROVED HOLDER FOR IT

[76] Inventor: Georgios Panagiotoulis, II, Velvendous Street, Athens, Greece

[21] Appl. No.: 623,610

[22] Filed: Oct. 20, 1975

[30] Foreign Application Priority Data

| | | |
|---|---|---|
| Oct. 25, 1974 | Greece | 5464 |
| Nov. 29, 1974 | Greece | 5650 |
| Aug. 28, 1975 | Greece | 7284 |

[51] Int. Cl.[2] ..... B26B 21/22; B26B 21/54

[52] U.S. Cl. ..... 30/50; 30/86; 30/346.59

[58] Field of Search ..... 30/62–65, 30/86, 329, 346.58, 346.59, 349, 50

[56] References Cited

U.S. PATENT DOCUMENTS

| | | | |
|---|---|---|---|
| 915,989 | 3/1909 | Morre | 30/346.58 X |
| 971,772 | 10/1910 | Millar | 30/346.58 X |
| 1,124,690 | 1/1915 | Barnett | 30/349 |
| 1,225,409 | 5/1917 | Cecil | 30/346.59 X |
| 1,356,799 | 10/1920 | Tompson | 30/50 |
| 2,321,351 | 6/1943 | Ardner | 30/346.59 X |
| 2,582,913 | 1/1952 | Pfefferle | 30/346.59 |
| 3,299,507 | 1/1967 | Mistretta | 30/86 X |

FOREIGN PATENT DOCUMENTS

| | | | |
|---|---|---|---|
| 882,045 | 7/1953 | Germany | 30/346.59 |
| 582,958 | 12/1946 | United Kingdom | 30/86 |

*Primary Examiner*—Gary L. Smith

[57] ABSTRACT

A holder for a razor blade is provided comprising a pair of spaced limbs having opposed internal surfaces defining an elongate seat which in use receives a strip blade, the seat having a depth less than the depth of a blade to be used so that the cutting edge of the blade projects beyond the spaced limbs and the spacing between the limbs being such that a blade to be used is held in position during use by surface adhesion between said opposed internal surfaces and the surface of the blade, the depth of the seat being limited by means forming the back of the seat against which the blade abuts to limit penetration of the blade between the limbs, said limit means extending only a part of the length of said seat and including a pivot point spaced from one end of the seat, removal of a blade being effected by rearward pressure on the blade at said one end of the seat so that the blade pivots about said pivot point.

5 Claims, 13 Drawing Figures

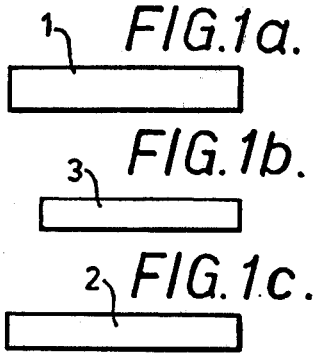
FIG.1a.
FIG.1b.
FIG.1c.
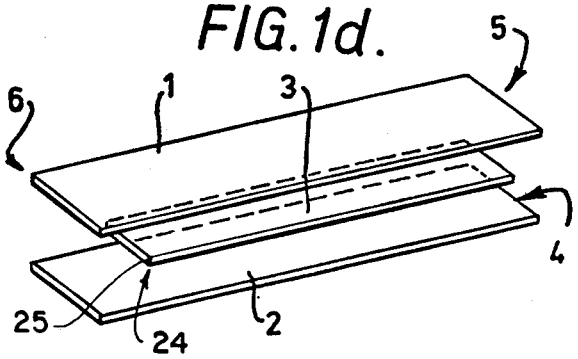
FIG.1d.
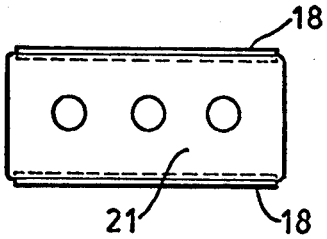
FIG. 4b.
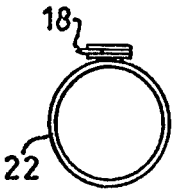
FIG. 4a.
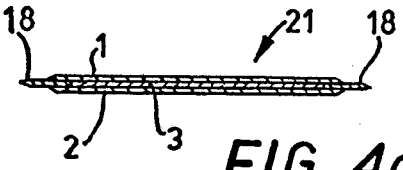
FIG. 4c.

BLADE AND IMPROVED HOLDER FOR IT

FIELD OF THE INVENTION

This invention relates to a new form of holder for a blade. The invention is particularly applicable to a holder for a blade of a shaving razor but may be used as a holder for a blade of any other device for example a dissection knife or scalpel.

BRIEF DESCRIPTION OF THE PRIOR ART

As a result of progress made in the metallurgy field during recent years new alloys have been developed which when used for blades give improved properties. However these new alloys are more expensive than previously used materials and therefore it is desirable that as little of the new materials as possible be used in making blades.

Particularly in the art of shaving razors there are a large number of disclosures of small blades which are embedded permanently in a holder. The disadvantages of such a holder are:

a. when the blade needs replacing the blade and the holder have to be replaced;
b. the blades used in such devices are still not small enough; and
c. a blade, if displaced within such a holder, for example if a device is dropped, cannot be replaced in its correct location so that there is a danger of a user being injured if the device is subsequently used.

SUMMARY OF THE PRESENT INVENTION

A main object of the present invention is to provide an improved holder for a blade which allows replacement of a blade without replacement of the holder.

According to the present invention a holder for a blade comprises a pair of spaced limbs having opposed internal surfaces defining an elongate seat which in use receives a strip blade, the seat having a depth less than the depth to be used so that the cutting edge of the blade projects beyond the spaced limbs and the spacing between the limbs being such that a blade to be used is held in position during use by surface adhesion between said opposed internal surfaces and the surface of the blade, the depth of the seat being limited by means forming the back of the seat against which the blade abuts to limit penetration of the blade between the limbs, said limit means extending only a part of the length of said seat and including a pivot point spaced from one end of the seat, removal of a blade being effected by rearward pressure on the blade at said one end of the seat so that the blade pivots about said pivot point.

Preferably the invention also includes a shaving razor having a holder for a blade as set out above which additionally may include a light weight handle within which is a storage pocket for new replacement blades.

When the holder of the invention is used as a holder for a shaving blade the spaced limbs are preferably of slightly different widths to allow easy shaving and facilitate the insertion of the blade.

DESCRIPTION OF THE DRAWINGS

The invention will now be described by way of example with reference to the accompanying drawings in which:

FIGS. 1*a*, 1*b* and 1*c* illustrate individual components of one embodiment of the invention;

FIG. 1*d* is a diagrammatic exploded view of the assembly;

FIGS. 4*a*, 4*b* and 4*c* are alternative embodiments of the holder;

DESCRIPTION OF THE PREFERRED EMBODIMENTS

Figure 2:
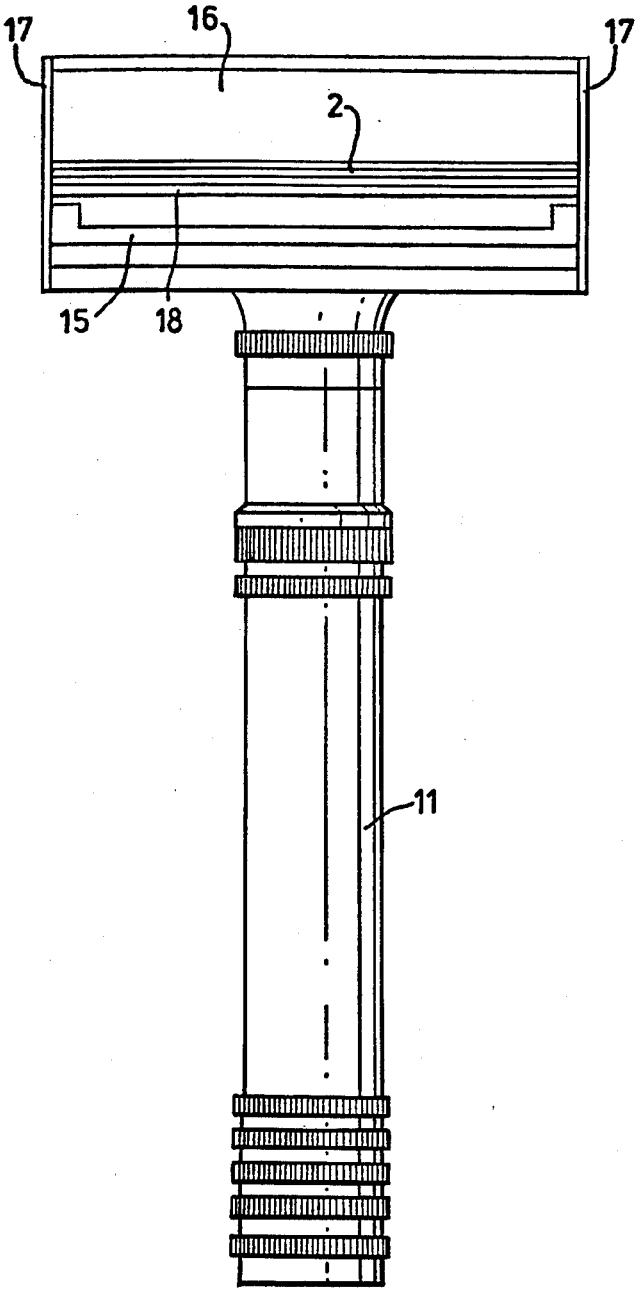
FIG. 2 is a side elevation of a shaving razor including a holder in accordance with the invention.

In the drawings a holding device consists of a rectangular first limb 1 (FIG. 1*a*), a rectangular second limb 2 (FIG. 1*c*) of slightly smaller width than the limb 1 and an intermediate plate 3 (FIG. 1*b*) which is slightly smaller in width than both limbs 1 and 2 and is slightly shorter in length.

Referring now to FIG. 1*d* it is seen that the limbs 1 and 2 and the intermediate plate 3 together define a blade receiving seat 4: it being understood that the FIG. 1*d* is an exploded view for clarity whereas in practice the limbs 1 and 2 and the intermediate plate 3 will be secured together by adhesive or by welding or in any other suitable manner. The front edge of the intermediate plate 3 forms the back of the seat 4 against which a blade abuts to limit penetration of the blade between the limbs. FIG. 1*d* also shows that the limbs 1 and 2 and the plate 3 lie flush at an end 5 so that the intermediate plate 3 stops short of the other end 6 of the holder. The front corner 25 of the intermediate plate 3 not flush with the edge of the limbs 1 and 2 forms a pivot point for a blade the use of which will be more fully described hereinafter.

The holder, which may be used in many different applications, has a blade-receiving seat 4 which is selected according to the thickness of the blade to be used so that the internal surfaces of the limbs 1 and 2 bear against the external surfaces of the blade. In this way a blade of a very small width can be used, the intermediate plate 3 being of a width to allow full penetration of the blade whilst leaving a certain amount of the blade protruding. It is understood that in all the different applications the holder must be mounted in such a way that lateral displacement of the blade is avoided.

Figure 3:
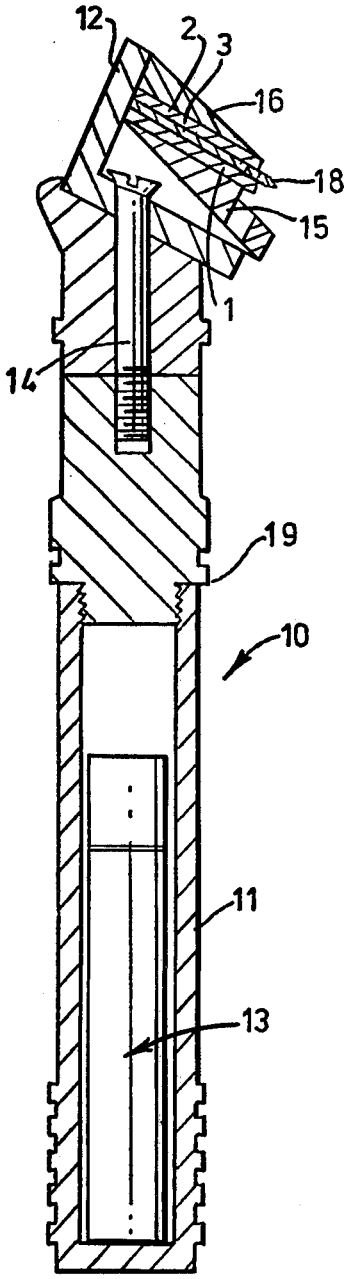
FIG. 3 is a longitudinal sectional view of the shaving razor in FIG. 2.
Figure 5B:
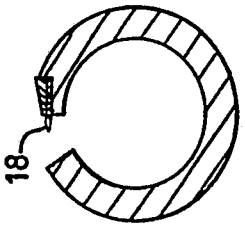
FIGS. 5*a* and 5*b* are a side elevation and sectional view respectively of a ball-point pen including a blade holder according to the invention.
Figure 6B:
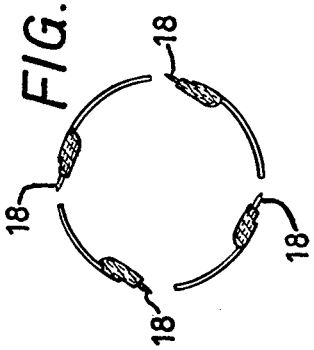
FIGS. 6*a* and 6*b* are a side elevation and a sectional view of an alternative form of pen including a blade holder according to the invention.
Figure 5A:
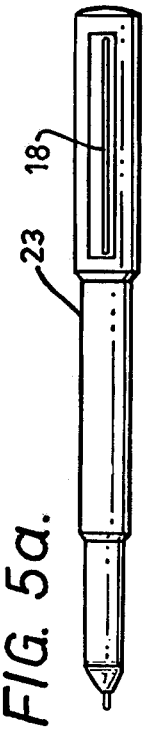
Figure 6A:
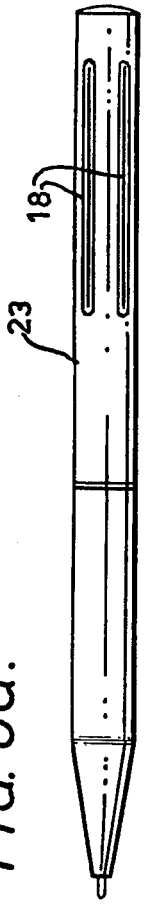

In FIGS. 2 and 3 the holder of the invention is applied to a shaving razor. The razor 10 has a handle 11 and a blade mounting 12 and is formed with a storage pocket 13 within the handle. The blade mounting 12 is L-shaped in cross-section and is secured to the handle 11 by a screw 14 in a downwardly inclined position—see FIG. 3. The holder is located in position on the mounting 12 between a lower support 15 and an upper protective plate 16 both being triangular in cross-section. The lower support 15 is provided with an upward projection 17 at each end which bear against the sides of the holder and form the lateral stops required to prevent displacement of a blade.

FIGS. 2 and 3 show a blade 18 in position and clearly illustrate in cross-section how small in width the blade is compared with known blades which require to be clamped to a holder.

The storage pocket 13 in the handle 11 is accessible by turning the handle 11 to release the screw connection at 19 and conveniently holds a roll of material containing blades 18 disposed transversely of the roll.

The holder of the present invention can be used in various different ways other than in a shaving razor and these are illustrated in FIGS. 4*a*, 4*b*, 4*c*, 5*a* and 5*b*. FIGS. 4*b* and 4*c* for example illustrate how a holder of the present invention can be adapted to provide a double-sided razor blade 21 of conventional shape for use with a conventional shaving razor. FIG. 4*a* illustrates a holder mounted on a ring 22 so that the ring and holder may be placed upon a user's finger for accurate cutting.

FIGS. 5*a*, 5*b*, 6*a* and 6*b* illustrate holders for blades mounted on ball-point pens 23; when not in use the blades may either be removed or covered by a sheath (not shown).

In order to remove a blade from the holder in accordance with the invention that part of the blade which is seated at the end 6, where the intermediate plate 3 stops short of the end of the holder, is pressed inwardly at 24 so that the blade pivots aobut the pivot point 25. With this pivoting action the greater part of the blade disposed at the end 5 is moved outwardly of the seat 4 so that the blade is then readily removed by hand. To insert a blade, one end of the blade is inserted at the end 5 and then the blade moved inwardly to its seat 4 by pivoting the blade about the pivot point 25. A blade once it is in the seat 4 is held in position by adhesion forces between the blade and the internal surfaces of the seat. It will be understood, for example, that during shaving the blade is drawn across the hairs of the beard so the blade is urged against one of the limbs defining the seat 4 which increases the adhesion forces. Also the fact that the beard is wetted before shaving also increases this adhesion effect.

Although the figures and the related specific description illustrate preferred embodiments it is understood that many other modifications may be made for example:

i. a device including the holder may be provided with a magnet to attract the blade towards the lower limb thus assisting the adhesion forces in retaining the blade in position;

ii. either of the limbs defining the seat can be provided with projections which co-operate with slots in the blade to prevent lateral displacement of the blade or the projections may be on the blade and the slot in the limb;

iii. the two spaced limbs of the holder may be formed from one integral folded sheet, or the spaced limbs and the intermediate plate may be one integral unit.

iv. The adhesion forces referred to herein are a function of the smoothness of the internal surfaces of the seat and of the blade, and the tightness of fit between the blade and the limbs 1 and 2: The presence of a minute film of grease or oil on the co-operating surfaces enhancing the adhesion effect. By making a blade light and thin the adhesion forces necessary to hold a blade in position are considerably reduced so that the width of a blade can be reduced to a minimum for example as is the blade in the shaving razor of FIG. 2.

v. Another way of making the holder of FIG. 1*d* is to weld the middle limb with either the above or below one (e.g. FIGS. 1*a* or 1*c*) and the addition of a fastener (preferably screw fastener) facilitating the opening and closing of the two limbs so that replacement of the blade and cleaning of the device-razor could be made easier.

What I claim is:

1. A holder for a blade comprising a pair of spaced limbs permanently fixed in position relative to one another and having opposed internal surfaces defining an elongate seat which in use receives a strip blade, the seat having a depth less than the depth of a blade to be used so that the cutting edge of the blade projects beyond the spaced limbs and the spacing between the limbs being such that a blade to be used is held in position during use primarily by surface adhesion between said opposed internal surfaces and the surface of the blade, the depth of the seat being limited by means forming the back of the seat against which the blade abuts to limit penetration of the blade between the limbs, said limit means extending only a part of the length of said seat so that a pivot point is formed spaced from one end of the seat, whereby rearward pressure on the blade at said one end of the seat causes the blade to pivot about said pivot point releasing the blade at the other end of the seat to enable removal.

2. A holder for a blade according to claim 1 wherein the limbs are of substantially the same rectangular shape and are spaced by a rectangular intermediate plate having a length and breadth smaller than that of the limbs.

3. A holder according to claim 2 wherein the intermediate plate constitutes said limit means.

4. A holder according to claim 3 wherein the limbs and intermediate plate are flush along the back and the other end, the pivot point being formed by that front corner of the rectangular intermediate plate not flush with the edge of the limbs.

5. A shaving razor having a handle and a holder for a blade wherein the holder for the blade comprises a pair of spaced limbs permanently fixed in position relative to one another and having opposed internal surfaces defining an elongate seat which in use receives a strip blade, the seat having a depth less than the depth of a blade to be used so that the cutting edge of the blade projects beyond the spaced limbs and the spacing between the limbs being such that a blade to be used is held in position during use primarily by surface adhesion between said opposed internal surfaces and the surface of the blade, the depth of the seat being limited by means forming the back of the seat against which the blade abuts to limit penetration of the blade between the limbs, said limit means extending only a part of the length of said seat so that a pivot point is formed spaced from one end of the seat whereby rearward pressure on the blade at said one end of the seat causes the blade to pivot about said pivot point releasing the blade at the other end of the seat to enable removal.

* * * * *